US005749279A

United States Patent [19]

Gardner

[11] Patent Number: 5,749,279

[45] Date of Patent: May 12, 1998

[54] HYDRAULIC PUNCH ACTUATOR WITH CENTERING APPARATUS

[75] Inventor: Thomas Haley Gardner, Englewood, Ohio

[73] Assignee: General Motors Corporation, Detroit, Mich.

[21] Appl. No.: 618,949

[22] Filed: Mar. 20, 1996

[51] Int. Cl.[6] ..... B26D 5/04; B26D 5/12

[52] U.S. Cl. ..... 83/639.1; 83/685; 83/686

[58] Field of Search ..... 83/556, 558, 639.1, 83/639.5, 640, 684, 685, 686

[56] References Cited

U.S. PATENT DOCUMENTS

| | | | |
|---|---|---|---|
| 3,949,631 | 4/1976 | Goldman et al. | 83/639.1 X |
| 4,214,496 | 7/1980 | Carrieri | 83/639.5 X |
| 4,339,975 | 7/1982 | Carrieri | 83/639.5 X |
| 4,633,742 | 1/1987 | Gutowski et al. | 83/639.1 X |
| 4,833,884 | 5/1989 | Seko et al. | 83/639.5 X |
| 5,182,985 | 2/1993 | Gutowski | 83/639.1 X |
| 5,492,041 | 2/1996 | Valkanov | 83/639.1 X |

*Primary Examiner*—Rinaldi I. Rada
*Assistant Examiner*—Clark F. Dexter
*Attorney, Agent, or Firm*—Donald F. Scherer

[57] ABSTRACT

A punch has a hydraulic actuating system incorporating reciprocal pumps and a reciprocal motor. The motor drives a punch secured to a punch plate or retainer into a die to cut friction pads from a sheet of material for placement in a carriage or directly onto a clutch plate. The punch retainer has a resting position during which the sheet of friction material is not contacted by the punch. To ensure the proper resting position, a plurality of power cylinders are pressurized to extend rod members to contact and position the punch retainer as required.

2 Claims, 4 Drawing Sheets

HYDRAULIC PUNCH ACTUATOR WITH CENTERING APPARATUS

TECHNICAL FIELD

This invention relates to hydraulically driven punches for cutting friction pads from a sheet of material.

BACKGROUND OF THE INVENTION

Friction pads can be punched or die-cut from a sheet of material with mechanically driven punches or with hydraulically driven punches. The friction pads are punched into a receiver that is rotationally indexed when the punch is withdrawn from the material. The mechanically driven punches have a mechanical connection, such as a belt, between indexing apparatus, such as a Geneva drive, and the punch driver, such as a cam. With mechanical systems, if the indexer and punches are out-of-phase, which will seldom occur, the machine must be stopped and the corrections made to the drive mechanism. However, the mechanical systems have a space constraint that may be a drawback.

In hydraulically operated punches, the hydraulic motor which drives the punch is powered by hydraulic fluid from a remote pump. Generally, the pump and indexing mechanism have a fixed relation while the pump and motor have only the hydraulic connection. Since the hydraulic connection can permit variance between the pump and motor stroke timing for many reasons, including fluid leakage, the phase relation between the indexing mechanism and the motor operation becomes a more important factor.

SUMMARY OF THE INVENTION

The present invention provides an improved hydraulic punch operation for cutting clutch facings as a primary object.

In one aspect of this invention, a punch, secured to a punch retainer or punch plate, is driven linearly by a hydraulic motor to cut clutch pad segments from sheet material and place the pad segment in a carrier. The hydraulic motor has a dwell time while the carrier is indexed to accept the subsequently cut pad and the cutting is repeated until a complete annulus is formed. During the dwell time, the punch must be fully withdrawn from the sheet material to a neutral position. To ensure the establishment of the neutral position, the punch holder is hydraulically centered independently of the motor.

In another aspect of the invention, the hydraulic centering apparatus has three fluid motor actuators or power cylinders which, when pressurized, force the punch retainer to a neutral position within a cavity in the table of the apparatus. In this position, the punch is spaced properly relative to the sheet material. A fluid circuit including control valving, such as pilot operated check valves, is provided to energize the centering apparatus at scheduled intervals or as desired by the operator.

DESCRIPTION OF AN EXEMPLARY EMBODIMENT

Figure 1:
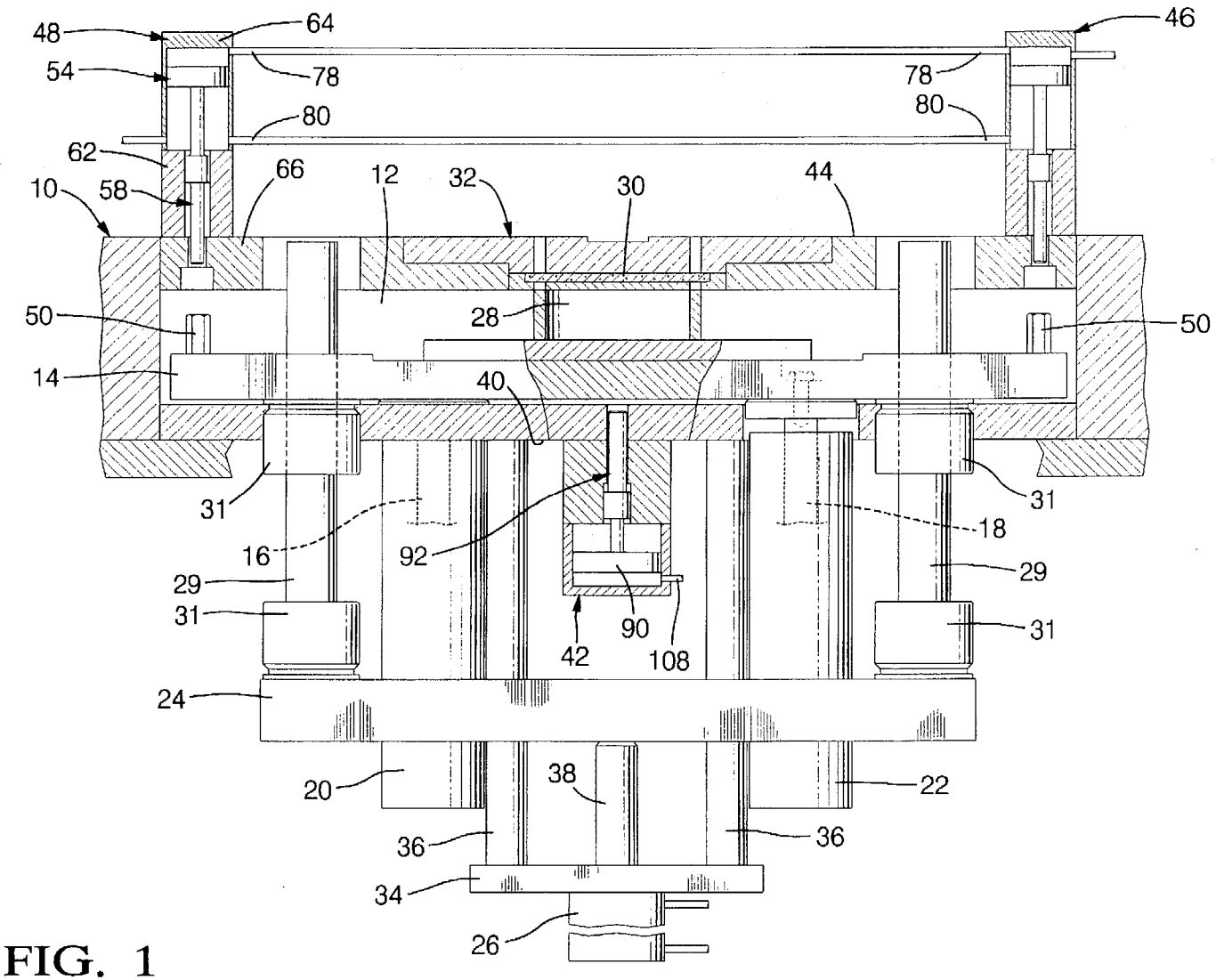
FIG. 1 is a partial elevational view of a machine for cutting friction material incorporating the present invention.

Referring to FIG. 1, there is seen a portion of a die-cutting or punch press utilized to sever or punch segments from a sheet of material for placement into a carriage. The machine includes a table 10 having a cavity 12 in which a punch plate or punch retainer 14 is positioned. The punch retainer is driven reciprocably by a pair of rods 16 and 18 which are secured to air cylinders or air springs 20 and 22, respectively, on a platform 24.

The platform 24 is driven reciprocably by a hydraulic motor, generally indicated at 26. The hydraulic motor 26 is a conventional reciprocal device, the construction of which is well known. The retainer 14 has secured therewith a punch member 28 which when driven reciprocably by the motor 26 punches a segment of friction material from sheet material 30 through a die assembly 32 for placement in a carriage, not shown. The die assembly 32 can include a die, die retainer and stripper.

The structure of the carriage and the indexing thereof may be seen in U.S. Pat. No. 5,361,480 issued to Gardner et al. Nov. 8, 1994, and assigned to the assignee of this application. The structure defined in the above-noted patent is a mechanical control or operating system which does not include a centering feature to be described later herein. For a description of a hydraulic or fluid operated punch apparatus, U.S. Ser. No. 08/618,951, filed Mar. 20, 1996, may be referred to by the reader.

The platform 24 is guided in its reciprocal motion by a pair of guide rods 29 which are located in bearings 31 disposed on both the platform 24 and the table 10. The motor 26 is secured to a support plate 34 which is suspended on support rods 36 from the table 10. The motor 26 has an output shaft or rod 38 which is secured to the platform 24 to provide the reciprocal motion needed for the punch 28 to pierce the material 30 at the die 32.

Also secured to the table on an underside 40 thereof is a centering motor or power cylinder 42. Secured to the upperside 44 of a plate or adapter 66 is a pair of centering motors or power cylinders 46, 48. The motors 46 and 48 are identical and are shown in more detail in FIG. 3. The motor 42 is shown in more detail in FIG. 2 and incorporates a shorter stroke than the motors 46 and 48.

The retainer plate 14 has a pair of hardened posts or rest buttons 50 which are axially aligned with the motors 46 and 48. The rest buttons 50 are threaded into the punch retainer 14 to permit removal thereof. The hardened rest buttons are utilized so as to save the surface of the retainer plate from the engagement by the motors 46 and 48.

Figure 3:
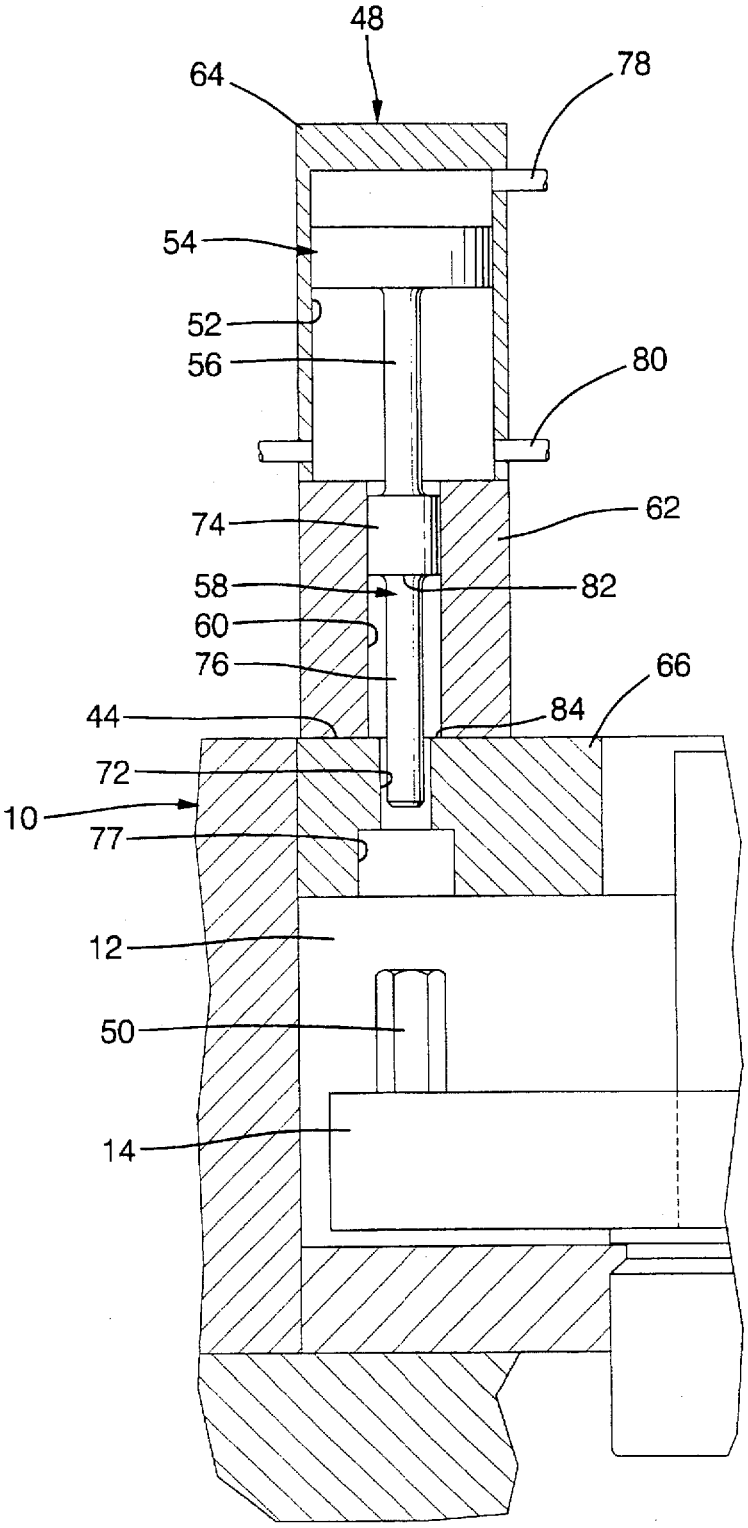
FIG. 3 is an enlarged view of another portion of FIG. 1.

Referring to FIG. 3, it is seen that the motor 48 has a cylinder portion 52 in which a piston 54 is slidably disposed. The piston 54 has a rod 56 which is secured to an extension rod 58. The extension rod 58 is slidably disposed in a cylindrical bore 60 formed in a spacer 62. The cylinder 52 is formed in a housing 64 which is secured to the spacer 62 and to the plate 66 which is secured to the table 10.

The plate 66 has an opening 72 which is smaller in diameter than the bore 60. The extension 58 has a large diameter portion 74 and a smaller diameter stem 76. The stem 76 is slidably disposed in the opening 72 such that upon actuation of the piston 54, the extension 58 can move downward and the stem 76 will pass through the opening 72 toward the rest button 50. The plate 66 has a counterbore or enlarged opening 77 into which the button 50 will enter when the punch retainer 14 is reciprocated upward by the motor 26. However, the retainer 14 will not move sufficiently for the button 50 to contact the inside of the plate 66.

The power cylinder 48 has a pair of fluid passages or air lines 78 and 80 connected therewith which are adapted to receive fluid pressure, such as air pressure, to reciprocably drive to piston 54. When the passage 78 is pressurized, the piston 54 will move downward causing a shoulder 82 formed on the extension 58 to abut a shoulder 84 formed on the upperside 44 of the plate 66. At this point, the stem 76 will extend downward from the opening 77 to establish the uppermost position of the punch retainer 14. If the punch retainer 14 is higher than the desired neutral position, the extension 58 will abut the rest button 50 forcing the punch retainer 14 downward within the cavity 12. The motor 46 is identical to the motor 48 such that the same operation will occur at the other motor 46 and button 50. Thus, the upper limit for positioning of the punch retainer 14 is determined by the motors 46 and 48.

Figure 2:
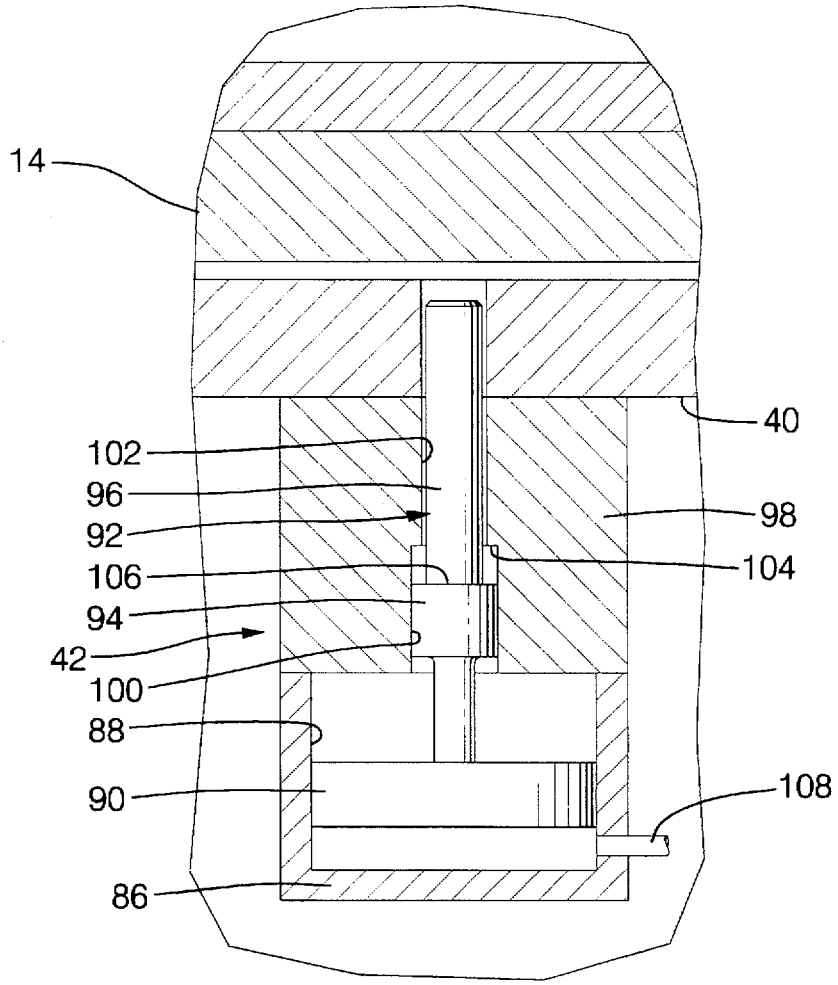
FIG. 2 is an enlarged view of a portion of FIG. 1.

The motor 42 is shown in FIG. 2. The motor 42 is comprised of a housing 86 in which is formed a cylinder 88 having slidably disposed therein a piston 90. The piston 90 is secured to a cylinder extension 92 which has an enlarged portion 94 and a cylinder extension or stem portion 96. The housing 86 is secured to a spacer 98 which in turn is secured to the table 10. The spacer 98 has formed therein an opening 100 in which the enlarged portion 94 is slidably disposed. The stem 96 extends upwardly through an opening 102 of less diameter than the opening 100. The juncture of openings 100 and 102 form a shoulder 104 which cooperates with a shoulder 106 formed between the enlarged portion 94 and the stem 96.

The cylinder 88 is in fluid communication with a passage 108 which is adapted to receive air pressure as desired by the system to operate on the piston 90 to extend the piston and extension 92 upward until the shoulders 104 and 106 are in abutment. At this position, the stem 96 will be disposed to abut the lower surface of the punch retainer 14 should that be necessary thereby establishing the lower position of the punch retainer 14 with the cavity 12.

With the extension 92 fully extended into the cavity 12 to limit downward motion and the extensions 58 of motors 48 and 46 extended into the cavity 12 to limit upward movement through engagement with the rest buttons 50, an envelope equal to the width or thickness of the punch retainer 14 including the rest buttons 50 plus approximately a clearance of 0.0010 in. to 0.0020 in. (0.0254 mm to 0.0508 mm) will be provided. Thus, the retainer plate has a slight amount of room or space in which it can fluctuate between the positions set by the respective motors 46, 48 and 42.

The motor 42, if desired, can also have a second air passage connected to the cylinder 88 on the opposite side of piston 90 to drive the piston downward and remove the stem or extension 92 from the cavity 12. Both the motors 46 and 48 have the lower passage 80 which when pressurized will drive the piston 54 upward, as viewed in FIG. 3, to the position shown thereby removing the stem 76 from the cavity 12. Thus, during normal operation of the punch, the stems 96 and 76 are disposed out of the cavity and do not interfere with the operation of the punch retainer.

In the alternative, the return air lines for the motors 42, 46 and 48 can be eliminated and the retainer plate itself be utilized to move the extensions 76 and 96 to their unactuated positions.

When the centering motors 42, 46 and 48 are operated, the motor 26 will not be pressurized and both sides thereof will be connected to the reservoir 118 through the control 120. Thus, if it becomes necessary for the centering motors to manipulate the punch retainer 14 to a neutral position, the motor 26 is free to follow the movement of the punch retainer without exerting undue force on the centering motors.

Figure 4:
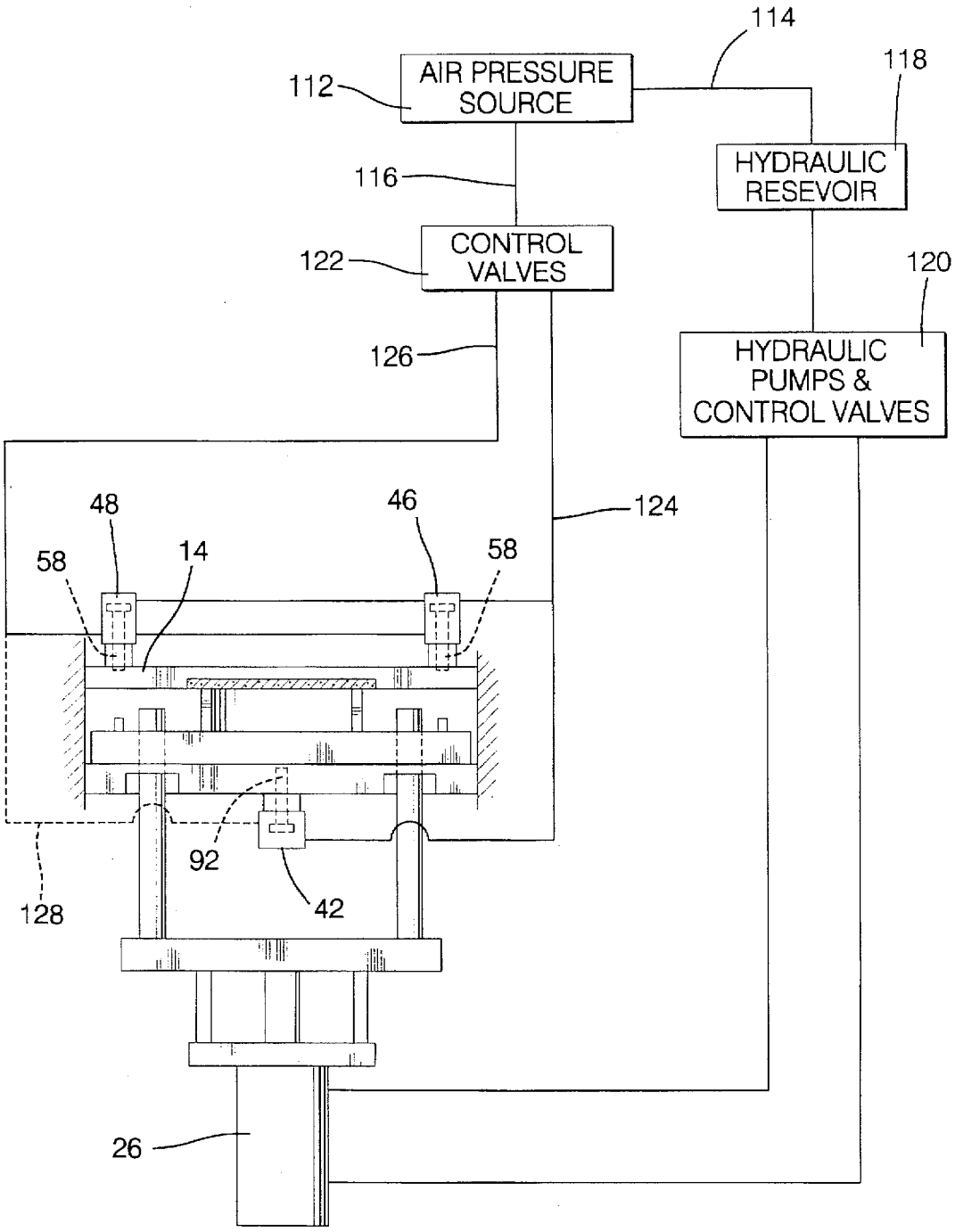
FIG. 4 is a schematic representation of a control system for the machine.

There is seen in FIG. 4 a schematic representation of a control system for the centering motors 42, 46 and 48.

The control system is comprised of an air pressure source 112 which is conventional in nature and is comprised of a conventional air pump and reservoir or tank for storing air under pressure. The air pressure source 112 has two outlet passages 114 and 116. Passage 114 is in fluid communication with a hydraulic reservoir 118 to maintain pressure thereon. The hydraulic reservoir 118 supplies the hydraulic control valves and pumps 120 which control the operation of the motor 26. A system utilizing this arrangement can be seen in above U.S. Ser. No. 08/618,951.

Passage 116 is connected to control valves 122 which are operable to provide fluid pressure to a passage 124 or a passage 126. The passage 124 is in fluid communication with the motors 42, 46 and 48 at a position to cause the cylinder extensions to be extended fully into the cavity. The passage 126 is in fluid communication with the motors 46 and 48 to control retraction of the cylinder extensions when pressurized. The passage 126 may also be connected as shown in the dashed line 128 to the cylinder 42 thereby enforcing retraction of the cylinder extension 92. The cylinder extensions of the centering motors 42, 46 and 48 will be effective as previously described to establish the neutral position of the punch retainer 14.

What is claimed is:

1. A hydraulic punch apparatus for providing neutral positioning of a punch, comprising:

a table;

punch retainer means having first and second surfaces disposed in a cavity in said table;

said punch secured to the first surface;

a fluid motor attached to said table and having a reciprocal output members for engaging said second surface of said punch retainer means for driving said punch to cut a sheet of material;

a source of fluid pressure;

a plurality of selectively energizable centering motors attached to said table, each having an extendable rod member extendable toward said cavity for selectively contacting one of said surfaces of said punch retainer means to urge said punch retainer means to a predetermined position in said cavity;

at least two of said plurality of centering motors being attached to said table and each said extendable rod member thereof being positionable at a first travel extent of the extendable rod members of said two centering motors to limit movement of said punch retainer means in one direction;

means for selectively connecting said source with said centering motors including means for directing fluid pressure to energize said centering motors;

and at least an additional one of said plurality of centering motors being attached to said table and said extendable rod member thereof being extendable toward said cavity for selectively contacting the other one of said surfaces of said punch retaining means, said extendable rod member of said additional centering motor being positionable at a second travel extent to limit movement of said punch retainer means in a direction opposite said one direction.

2. The hydraulic punch apparatus defined in claim 4, wherein:

said extendable rods at said first and second travel extents defining a space therebetween greater than a width dimension of said punch retainer means by a predetermined amount for limiting the movement of the punch retainer means.

* * * * *